US011712900B2

(12) United States Patent
Tanaka et al.

(10) Patent No.: US 11,712,900 B2
(45) Date of Patent: Aug. 1, 2023

(54) IMAGE RECORDING APPARATUS

(71) Applicant: CANON KABUSHIKI KAISHA, Tokyo (JP)

(72) Inventors: Kousuke Tanaka, Kanagawa (JP); Koya Iwakura, Kanagawa (JP); Hideaki Matsumura, Kanagawa (JP); Tetsu Hamano, Tokyo (JP); Nobuhiro Toki, Kanagawa (JP); Daiju Takeda, Kanagawa (JP); Fumie Kameyama, Tokyo (JP); Koki Shimada, Kanagawa (JP); Shota Asada, Tokyo (JP); Ken Takenaga, Kanagawa (JP); Yusuke Tanaka, Kanagawa (JP); Yuta Araki, Chiba (JP); Taiji Maruyama, Kanagawa (JP); Atsushi Matsuyama, Kanagawa (JP); Yusuke Naratani, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 80 days.

(21) Appl. No.: 17/384,836

(22) Filed: Jul. 26, 2021

(65) Prior Publication Data

US 2022/0032636 A1 Feb. 3, 2022

(30) Foreign Application Priority Data

Jul. 31, 2020 (JP) ..... 2020-130026

(51) Int. Cl.
*B41J 2/175* (2006.01)

(52) U.S. Cl.
CPC ..... *B41J 2/17523* (2013.01); *B41J 2/17513* (2013.01); *B41J 2/17596* (2013.01)

(58) Field of Classification Search
CPC ..... B41J 2/17523; B41J 2/17513; B41J 2/17596; B41J 2/175; B41J 2/17509; B41J 2/1752
USPC ..... 347/86
See application file for complete search history.

(56) References Cited

U.S. PATENT DOCUMENTS

| | | | |
|---|---|---|---|
| 5,321,467 | A | 6/1994 | Tanaka et al. |
| 5,592,262 | A | 1/1997 | Tanaka et al. |
| 5,798,773 | A | 8/1998 | Hiramatsu et al. |
| 5,974,191 | A | 10/1999 | Harada et al. |

(Continued)

FOREIGN PATENT DOCUMENTS

| | | | |
|---|---|---|---|
| JP | 2012-000871 | A | 1/2012 |
| JP | 2017-081086 | A | 5/2017 |

*Primary Examiner* — Matthew Luu
*Assistant Examiner* — Alexander D Shenderov
(74) *Attorney, Agent, or Firm* — Venable LLP

(57) ABSTRACT

Provided is an image recording apparatus including: a carriage configured to support a recording head that ejects a liquid to a recording medium and configured to perform reciprocating motion in the scanning direction; a liquid containing portion configured to contain liquid; a tube configured to connect the recording head and the liquid containing portion to supply liquid from the liquid containing portion to the recording head, the tube including a first section that extends in the scanning direction and a second section that extends in the scanning direction above the first section; and a support portion configured to support the first section and be secured to an apparatus main body, and in the support portion, a rotating member is provided below the second section at a position facing the second section.

13 Claims, 7 Drawing Sheets

(56) References Cited

U.S. PATENT DOCUMENTS

| | | | | |
|---|---|---|---|---|
| 6,113,217 | A * | 9/2000 | Araki | B41J 29/02 347/50 |
| 7,114,867 | B2 | 10/2006 | Ohashi et al. | |
| 7,588,311 | B2 | 9/2009 | Araki et al. | |
| 7,677,683 | B2 | 3/2010 | Iwakura | |
| 8,038,256 | B2 | 10/2011 | Araki et al. | |
| 8,109,585 | B2 | 2/2012 | Iwakura | |
| 8,262,216 | B2 | 9/2012 | Hamano et al. | |
| 8,727,526 | B2 | 5/2014 | Yamamoto et al. | |
| 9,106,862 | B2 | 8/2015 | Tanaka | |
| 9,738,081 | B2 | 8/2017 | Kimura et al. | |
| 10,118,396 | B2 | 11/2018 | Kimura et al. | |
| 10,654,264 | B2 | 5/2020 | Tanaka et al. | |
| 10,850,539 | B2 | 12/2020 | Tanaka et al. | |
| 2009/0040252 | A1 | 2/2009 | Tanaka et al. | |
| 2011/0267399 | A1 * | 11/2011 | Ikeda | B41J 2/16505 347/29 |
| 2017/0120609 | A1 | 5/2017 | Kimura et al. | |
| 2017/0305163 | A1 | 10/2017 | Kimura et al. | |

* cited by examiner

IMAGE RECORDING APPARATUS

BACKGROUND OF THE INVENTION

Field of the Invention

The present invention relates to an image recording apparatus that records an image on a recording medium by ejecting liquid to the recording medium.

Description of the Related Art

As an inkjet recording type printer (image recording apparatus) that records an image on a recording medium by ejecting ink, as ejection liquid, from a recording head, a configuration, in which a recording head (liquid ejection portion) and an ink tank (liquid containing portion) are separated, is known. In a printer having such a configuration, a type of printer that supplies ink to the recording head from the ink tank by using a tube or the like is known. In this type, an ink supply tube (hereafter "tube") has to be bent when a carriage holding the recording head performs reciprocation in the scanning direction, so as to smoothly follow the carriage operation. At the same time, the movement of the tube has to be restricted so that the tube does not sag down to the traveling surface of the carriage, or does not move without control.

For example, according to Japanese Patent Application Publication No. 2012-000871, the tube is laid in the longitudinal direction from the carriage, and is supported from the bottom by a rotatable support wire, so as to prevent contact with other sections of the image recording apparatus. According to Japanese Patent Application Publication No. 2017-081086, the tube is laid from the carriage in the vertical direction, so that the space to install the tube in the longitudinal direction can be reduced. Further, the tube is supported by a tube guide sheet using a holder slider, hence it can be prevented that the tube moves without control due to the movement of the carriage.

SUMMARY OF THE INVENTION

However, in the configuration proposed in Japanese Patent Application Publication No. 2012-000871, the support wire oscillates when the tube is moved along with the movement of the carriage. At that time, the tube holding portion or a part near the holding portion may be caught in the case of the apparatus.

In the configuration proposed in Japanese Patent Application Publication No. 2017-081086, on the other hand, if the carriage is left at a position facing the maintenance portion for a long time, the tube may sag down from the tube guide sheet and interrupt the movement of the carriage.

It is an object of the present invention to provide a technique to stabilize the operation of a carriage that moves a liquid ejection portion in an image recording apparatus configured to supply liquid from a liquid containing portion to a liquid ejection portion via a tube.

To solve the above problem, an image recording apparatus of the present invention includes:

a carriage configured to support a recording head that ejects liquid and configured to perform reciprocating motion in a scanning direction;

a liquid containing portion configured to contain liquid that is supplied to the recording head;

a tube configured to connect the recording head and the liquid containing portion to supply liquid from the liquid containing portion to the recording head, the tube including a first section that extends in the scanning direction and a second section that extends in the scanning direction above the first section;

a support portion configured to support the first section and be secured to an apparatus main body; and a rotating member provided in the support portion at a position facing the second section.

According to the present invention, the operation of the carriage that moves the liquid ejection portion can be stabilized in the image recording apparatus configured to supply liquid from the liquid containing portion to the liquid ejection portion via the tube.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment

Figure 1:
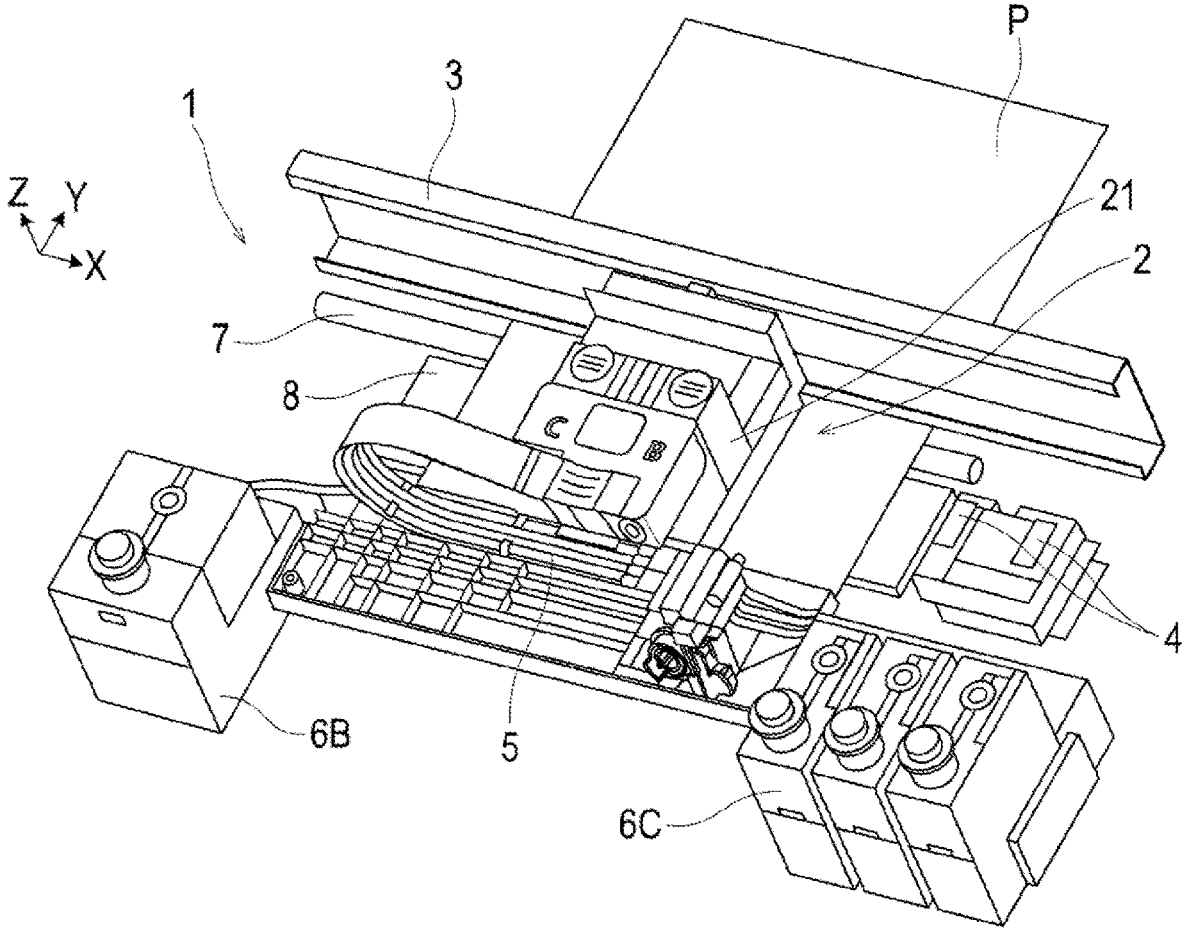
FIG. 1 is a schematic perspective view depicting a configuration of an image recording apparatus according to Embodiment 1 of the present invention.

FIG. 1 is a schematic perspective view depicting a general configuration of an inkjet recording apparatus 1, which is a printer using an inkjet recording system according to an embodiment of the present invention. The inkjet recording apparatus 1 (hereafter "recording apparatus 1") is a liquid ejection type image recording apparatus that forms and records a desired image on a recording medium by ejecting ink (liquid) to a recording medium (recording material). The recording apparatus 1 includes a recording head 22 which is held by a recording unit 2 and ejects ink (see FIG. 2C), tubes 5 which supply ink to the recording head 22, and ink tanks 6 which are liquid containing portions to contain ink. The recording unit 2 includes the recording head 22 and a carriage 21 which moves in a state of mounting the recording head 22.

In the recording apparatus 1, recording medium P stacked in a recording medium cassette (not illustrated) is fed one by one by a paper feeding roller (not illustrated), and is sent into a space between a conveying roller 7 and a pinch roller (not illustrated). The recording medium P, which is held between the conveying roller 7 and the pinch roller, is conveyed to a position facing the recording head 22 along the conveying direction (−Y direction). The recording medium P is supported by a platen 8 from the bottom, and is then printed by the recording head 22 mounted on the carriage 21, which performs reciprocating motion on a rail 3. The carriage 21 (recording unit 2) performs reciprocating motion in a scanning direction (X direction) which intersects (is perpendicular to) the conveying direction of the recording medium P, and a predetermined number of lines of an image is recorded on the recording medium P in one reciprocating cycle. The recording medium P is conveyed by the conveying roller 7 and the pinch roller in the conveying direction, so that a line region, where an image is recorded next, comes below an ink ejection port of the recording unit 2. Then the recording medium P is sent to a space between the discharging roller (not illustrated) and a spur (not illustrated), and is discharged into a paper delivery tray (not illustrated).

The recording apparatus 1 includes a suction cap 4 for maintaining or recovering the ejection performance of the recording head 22, and contacts the suction cap 4 with the recording head 22 in a standby state while waiting a print instruction, so as to prevent the drying of a nozzle (not illustrated) of the recording head 22. The recording apparatus 1 also sets the pressure in the internal space of the suction cap 4 to negative using a suction tube (not illustrated) and a pump (not illustrated), and sucks ink from the nozzle of the recording head 22 for a recovery operation of the nozzle. In the case where the standby time from the end of printing to the next printing is short, however the recording head 22 does not contact the suction cap 4, and stands by at a position that is closer to the print region, where the recording operation is performed by the recording head 22, than to the suction cap 4. In the following description, the cap position where the recovery operation is performed by the suction cap 4, and the position where the recording head 22 stands by without performing the recovery operation may be collectively referred to as "standby position".

Figure 2A:
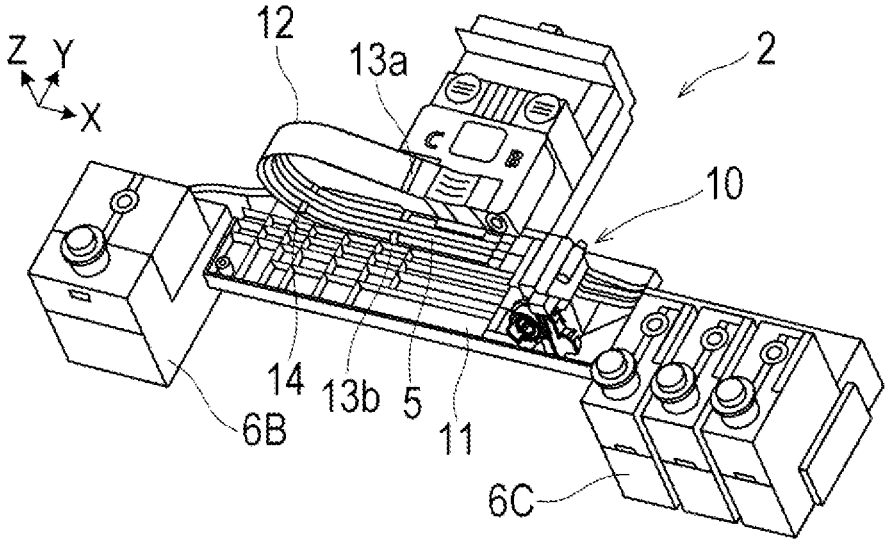
FIG. 2A to FIG. 2C are schematic diagrams depicting a configuration of an ink supply unit.
Figure 2B:
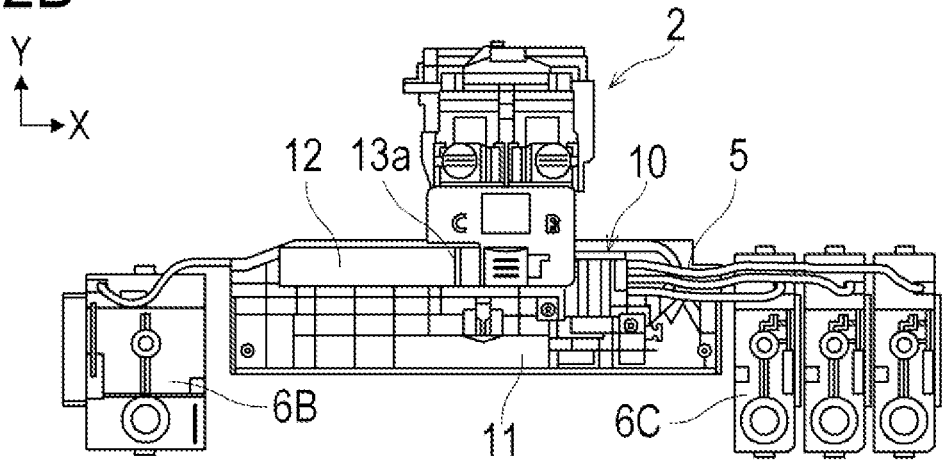
Figure 2C:
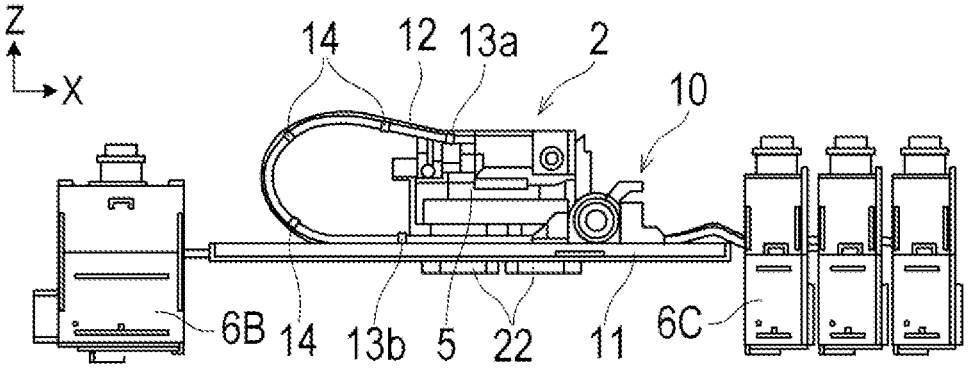

FIG. 2A is a perspective view depicting a configuration related to the ink supply (this is referred to as "ink supply unit") when the recording head 22 of the present embodiment is located above the print region. FIG. 2B is a top view of FIG. 2A, and FIG. 2C is a front view of FIG. 2A respectively. For the ink tanks 6, a black ink tank 6B and three types of color ink tanks 6C (cyan ink tank, magenta ink tank and yellow ink tank) are disposed on the front face of the apparatus main body respectively, and each ink tank has an ink injection port to inject ink respectively. The user can replenish the ink in each ink tank 6 by injecting ink into the ink tank 6 via the ink injection port. Each color of ink contained in an ink tank 6 is supplied to the recording head 22 via a flexible tube 5, which is provided corresponding to each color of ink. The present invention is not limited to the case of the ink tank 6 having the ink injection port, but is also applicable to a case of using a cartridge type ink tank which the user can replace.

Figure 3A:
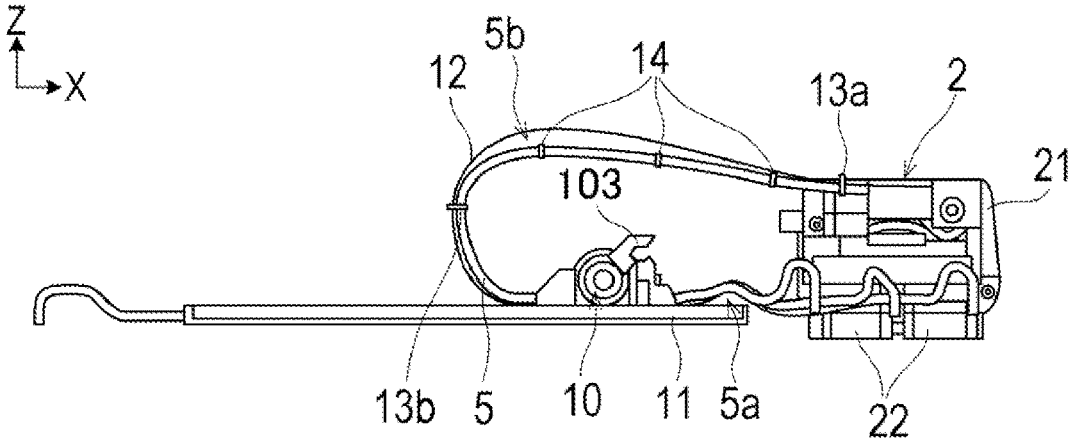
FIG. 3A and FIG. 3B are schematic diagrams of the ink supply unit when a recording unit is at a cap position.
Figure 3B:
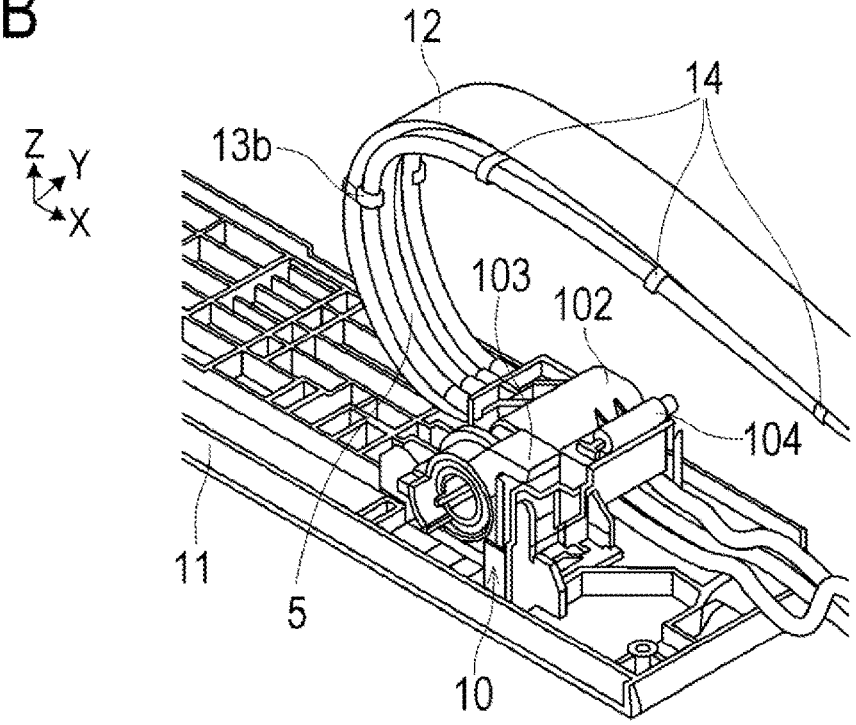

FIG. 3A is a schematic diagram depicting a configuration of the ink supply unit when the recording unit 2 is at a cap position, and FIG. 3B is an enlarged perspective view of a part of FIG. 3A. In FIG. 3A, illustration of the ink tanks 6 is omitted. The tubes 5, which connect the ink tanks 6 and the carriage 21 (recording head 22) are constituted of tube holders 14, tube holder sliders 13, a tube guide sheet 12, a tube guide plate 11, and a tube valve unit 10.

The tube guide plate 11 is disposed to extend over the conveying path of the recording medium P in the scanning direction, and the tubes 5 are disposed on the tube guide plate 11. The tubes 5 are laid in an approximate U shape along the scanning direction (horizontal direction) when viewed from the front face of the apparatus main body, such that the connecting portion connected with the carriage 21 comes on top of the connecting portion connected with the ink tank 6. In other words, the tubes 5 are laid from the ink tank 6 to the carriage 21 so as to be bent upwards. Specifically, a first section 5*a*, which extends from the connecting portion of each tube 5 with the corresponding ink tank 6 to one side in the scanning direction is secured to the tube guide plate 11 by the tube valve unit 10, which is a support portion (described later). A second section 5*b*, where the tubes 5 are curved and return from the first section 5*a* and extend above the first section 5*a* to the other side in the scanning direction, and are then connected to the carriage 21, changes its degree of deflection in accordance with the position of the recording unit 2, and changes its orientation when the recording unit 2 performs reciprocating motion. In other words, when the recording unit 2 performs reciprocating motion, the tube guide plate 11 plays a role of securing the unmovable section (first section 5*a*) of the tubes 5, and guiding the movable section (second section 5*b*) thereof.

The standby position of the recording unit 2 is on the same side (the other side) of the positions where the color ink tanks 6C are installed, and is a position that deviated from the conveying path of the recording medium P in the scanning direction. The position where the tube valve unit 10 secures the tubes 5 is above the conveying path. Therefore, when the tubes 5 enter above the conveying path from the other side in the scanning direction, and at least the recording unit 2 is at the standby position, the tubes 5 are laid above the conveying path so as to return to a position above the conveying path and be directed to the other side above the conveying path.

By the movement of the recording unit 2, the second section 5*b* of the tubes 5 repeats the cycle of contacting the tube guide plate 11 and separating from the tube guide plate 11 (changes orientation). In the second section 5*b*, the tube guide sheet 12 is disposed outside the returning portion of the second section 5*b* from one end side which is secured to the tube valve unit 10, to the other end side which is connected to the carriage 21. In other words, the tube guide sheet 12 is disposed between the second section 5*b* and the tube guide plate 11, and between the second section 5*b* and the case (not illustrated) of the recording apparatus 1. The tube guide sheet 12 guides the tubes 5 so as to prevent the tubes 5 from directly contacting the tube guide plate 11 or the case of the recording apparatus 1, and to minimize the tubes 5 from wearing out. One end of the tube guide sheet 12 is secured to the tube guide plate 11, and the other end thereof is secured to the recording unit 2 (carriage 21), hence the tube guide sheet 12 can also move (change orientation) along with the tubes 5 when the recording unit 2 performs reciprocating motion.

The tube holders 14 and the tube holder sliders 13 (13*a*, 13*b*) are installed on the tubes 5. The tube holders 14 bundle and hold a plurality of tubes 5, and also prevent the tubes 5 from contacting the tube guide sheet 12 so as to reduce tubes 5 wear. Each tube holder slider 13 includes an insertion portion to which the tube guide sheet 12 is inserted, and a holding portion that holds and secures the tubes 5. The tube holder sliders 13 bundle the tube guide sheet 12 and the tubes 5 at predetermined locations in the extending direction of the tube guide sheet 12, so as to prevent the separation of the tubes 5 and the tube guide sheet 12 by the reciprocating motion of the recording unit 2.

Figure 4A:
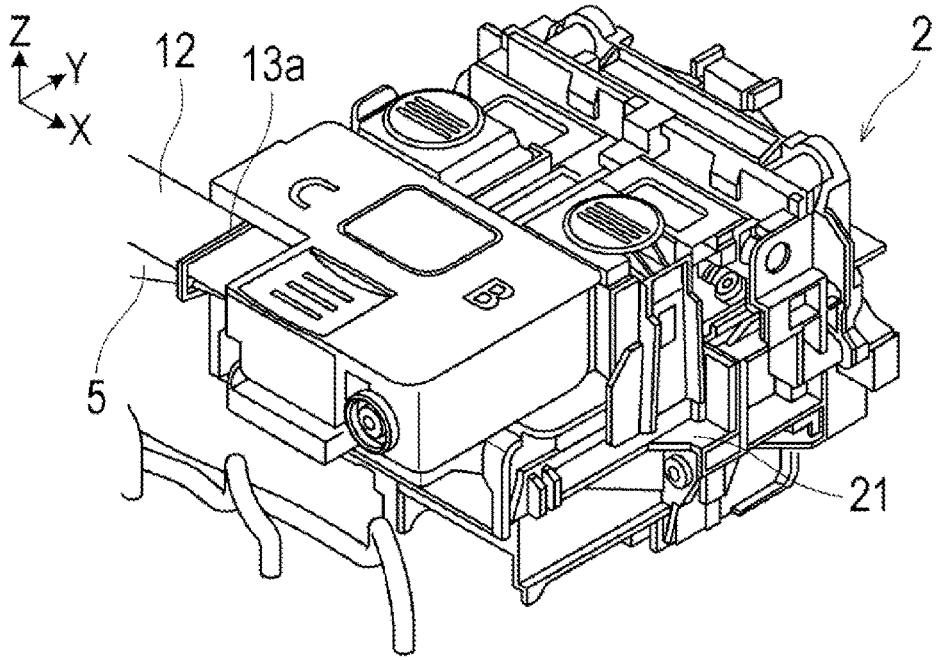
FIG. 4A and FIG. 4B are schematic diagrams depicting a configuration of an area around a carriage exit.
Figure 4B:
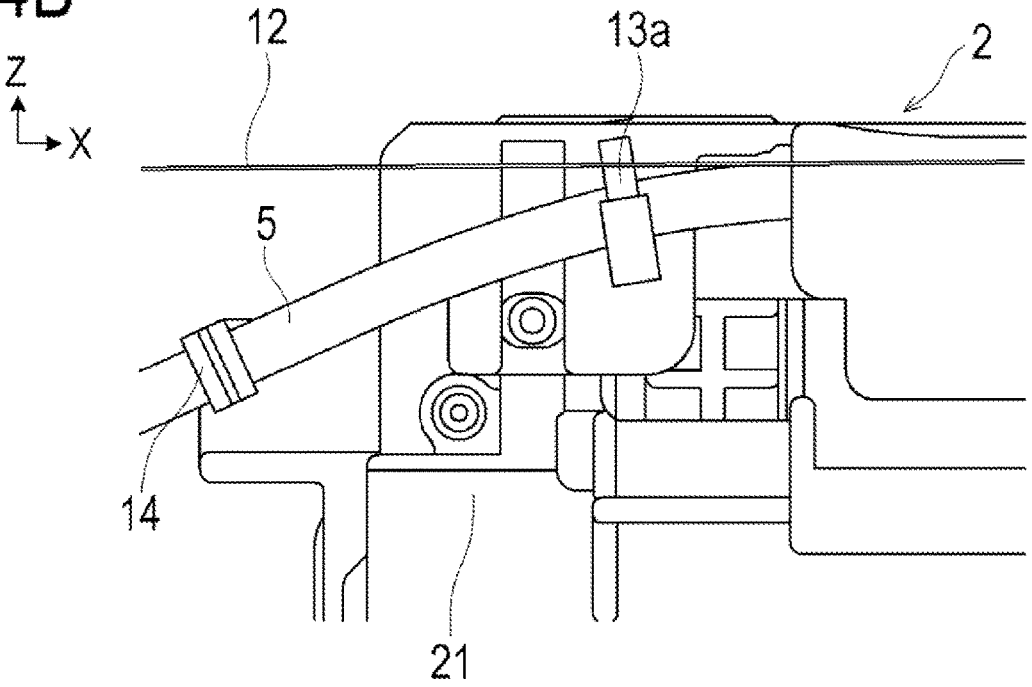

FIG. 4A is a perspective view depicting a state of securing the tube holder slider 13 (13*a*) to the tubes 5 and the tube guide sheet 12, in the vicinity of the connecting portion of the tubes 5 with the carriage 21. FIG. 4B is an enlarged front view of a part of FIG. 4A. The tube holder slider 13*a* is installed so as to bundle the vicinity of the other end of the tube guide sheet 12 and the vicinity of the connecting portion of the tubes 5 (second section 5*b*) with the carriage 21. The tube holder slider 13*b* is installed so as to bundle the vicinity of one end of the tube guide sheet 12 and the vicinity of the fixing portion of the tubes 5 (second section 5*b*) to the tube guide plate 11 by the tube valve unit 10 (see FIG. 3A and FIG. 3B).

Figure 5A:
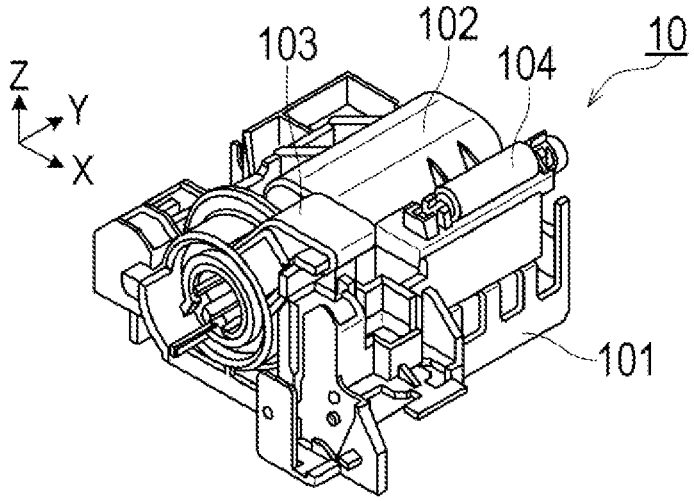
FIG. 5A to FIG. 5C are schematic diagrams depicting a configuration of a tube valve unit.
Figure 5B:
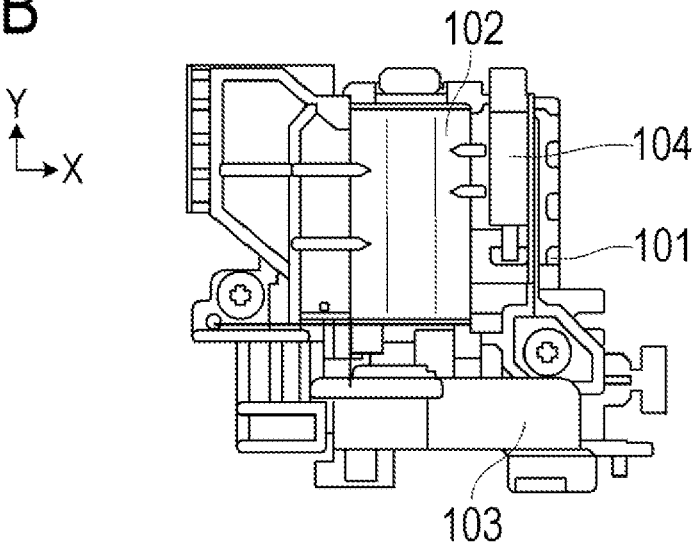
Figure 5C:
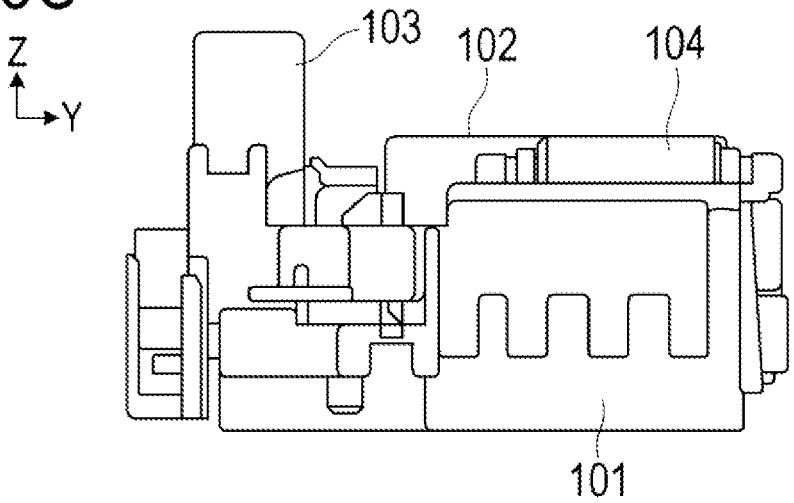

FIG. 5A is a perspective view of the tube valve unit 10, FIG. 5B is a top view thereof, and FIG. 5C is a right side view thereof. The tube valve unit 10 is disposed on the tube guide plate 11, and is constituted of a tube valve (not illustrated), a tube valve lever 103, a tube valve holder 102 (valve holder portion), and a tube valve base 101. The tube valve can be opened/closed by rotating this tube valve lever 103, and the ink supply via the tubes 5 can be controlled by the opening/closing of the ink passages of the tubes 5.

Figure 6A:
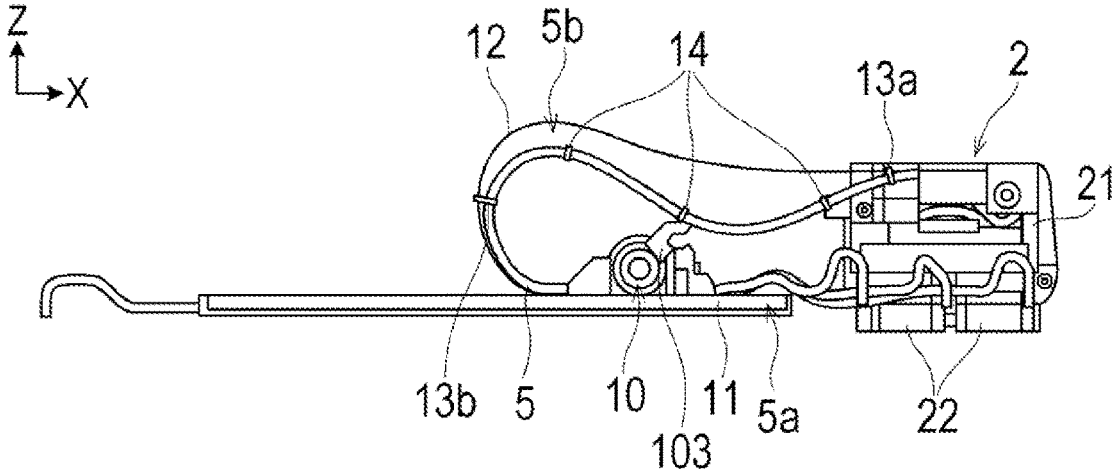
FIG. 6A and FIG. 6B are schematic diagrams depicting a state where tubes are sagging down after the recording unit is left for a long time.
Figure 6B:
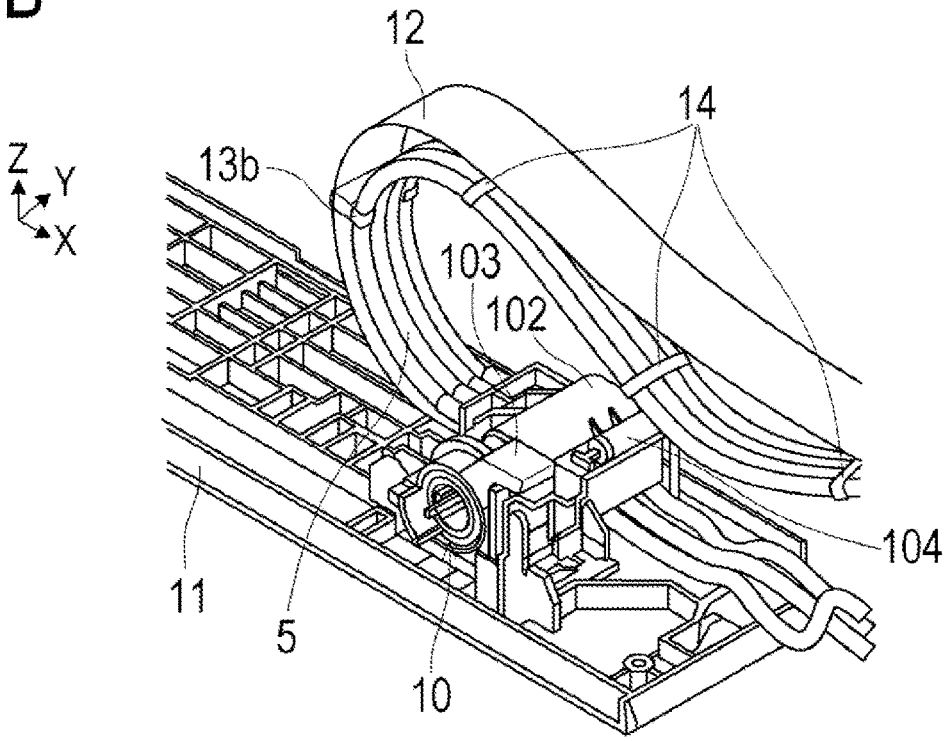

FIG. 6A is a schematic diagram depicting a state where the tubes 5 sag down after the recording unit 2 is left in a cap position (standby position) for a long time, and FIG. 6B is an enlarged perspective view of a part of FIG. 6A. The orientation of the tubes 5 when the recording unit 2 is moved will be described. When a print instruction is not received, the recording unit 2 moves to the cap position (standby position), as illustrated in FIG. 3A. In other words, in some cases, the recording unit 2 may be left for a long time in a state where the recording unit 2 is at the cap position (standby position) and the tubes 5 are laid from the side of the carriage 21 and the color ink tanks 6C to the print region side (above the conveying path). While the recording unit 2 is left in this state for a long time, creep deformation may occur to the tubes 5 in the vicinity of the connecting portion of the tubes (second section 5*b*) with the carriage 21, and the tubes 5 may separate from the tube guide sheet 12 and sag down in the gravity direction. In such a case, the tubes 5 approach the tube valve holder 102, which is the highest portion of the tube valve unit 10 located on the lower side of the second section 5*b* of the tubes 5 in the gravity direction, as illustrated in FIG. 6A and FIG. 6B.

In this embodiment, the amount of sagging down of the tubes 5 (second section 5*b*) is decreased by the tube holder slider 13*a*, which is installed in the vicinity of the connecting portion of the tubes 5 (second portion 5*b*) with the carriage 21. Further, a rotating member 104 is installed in the upper part of the tube valve unit 10, as illustrated in FIG. 5A to FIG. 5C. The rotating member 104 is a cylindrical rotating member (e.g. roller), and both edges thereof in the rotation axis direction are rotatably supported by a casing of the tube valve unit 10. The rotation axis of the rotating member 104 is in the direction perpendicular to the scanning direction (Y direction).

When the tubes 5 on the side of the connecting portion with the carriage 21 (second section 5*b*) sags down, the sagged portion contacts the rotating member 104 and is supported thereby. Further, when the shape (orientation) of the tubes 5 changes by the movement of the carriage 21, and the sagging portion of the tubes 5 moves in the scanning direction, the peripheral surface of the rotating member 104 rotates in the scanning direction in accordance with this movement, so as to guide the movement of the tubes 5. In other words, by the rotation of the rotating member 104, resistance to the movement of the tubes 5, which are moved with changing the shape by the movement of the carriage 21, can be decreased, and the movement of the carriage 21 is interrupted less.

The tubes 5 sag down (convex in the downward direction) mostly at the position in the second section 5*b* approximately at the center between the location where the tube holder slider 13*a* is installed and the location where the tube holder slider 13*b* is installed in the horizontal direction. In this embodiment, when the carriage 21 is at the standby position, the tube valve unit 10 is disposed at a position closer to the tube holder slider 13*b* than to the tube holder slider 13*a* in the horizontal direction (scanning direction). This means that the tube valve unit 10 is located on the side closer to the tube holder slider 13*b* (conveying path side) than to the position of the apex of the convex shape of the sagging tubes 5 (second section 5*b*). Therefore, it is preferable that the rotating member 104 is disposed on the side closer to the tube holder slider 13*a* in the tube valve unit 10 in the horizontal direction.

Furthermore, it is even more preferable to dispose the rotating member 104 on the side closer to the color ink tanks 6C (standby position of the carriage 21) than to the tube valve holder 102 in the tube valve unit 10. In the tube valve unit 10, the upper end of the tube valve holder 102 is the highest. Therefore, if the rotating member 104 is disposed at a position closer to the sagging portion of the tubes 5 (second section 5*b*) than this upper end position in the horizontal direction, the tubes 5 can contact the rotating member 104 before contacting the tube valve holder 102. The height of the rotating member 104 at this time may preferably be at least the same as the upper end of the tube valve holder 102, and depending on the configuration of the apparatus, the rotating member 104 may be installed at a height lower than the upper end of the tube valve holder 102. In other words, as long as contact of the sagging portion of the tubes 5 with the tube valve unit 10 (tube valve holder 102) can be prevented, the height of the upper end of the rotating member 104 may be the height of the upper end of the tube valve holder 102 or less. Then an increase in the size of the apparatus, caused by additionally installing the rotating member 104, can be avoided.

Figure 7A:
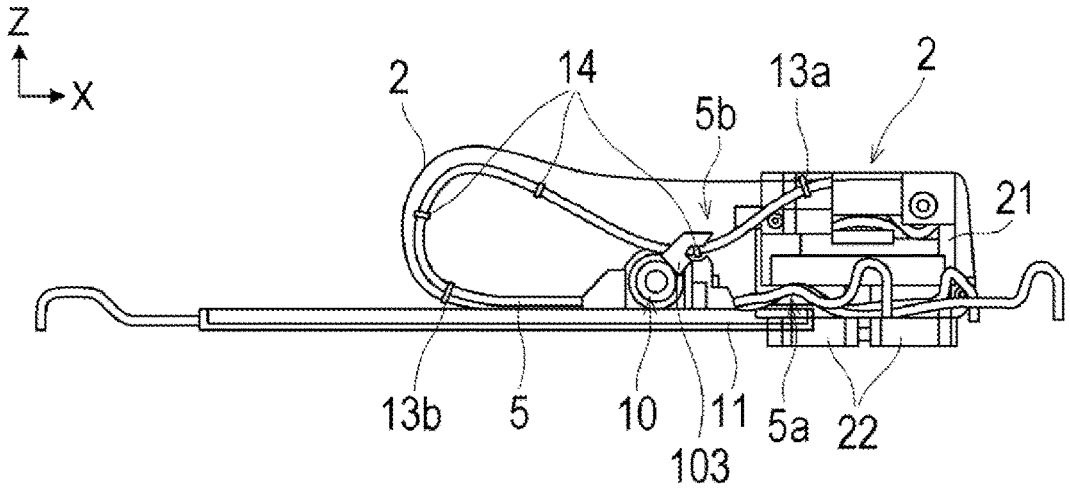
FIG. 7A and FIG. 7B are schematic diagrams depicting a state where a rotating member is supporting the sagging of the tubes.
Figure 7B:
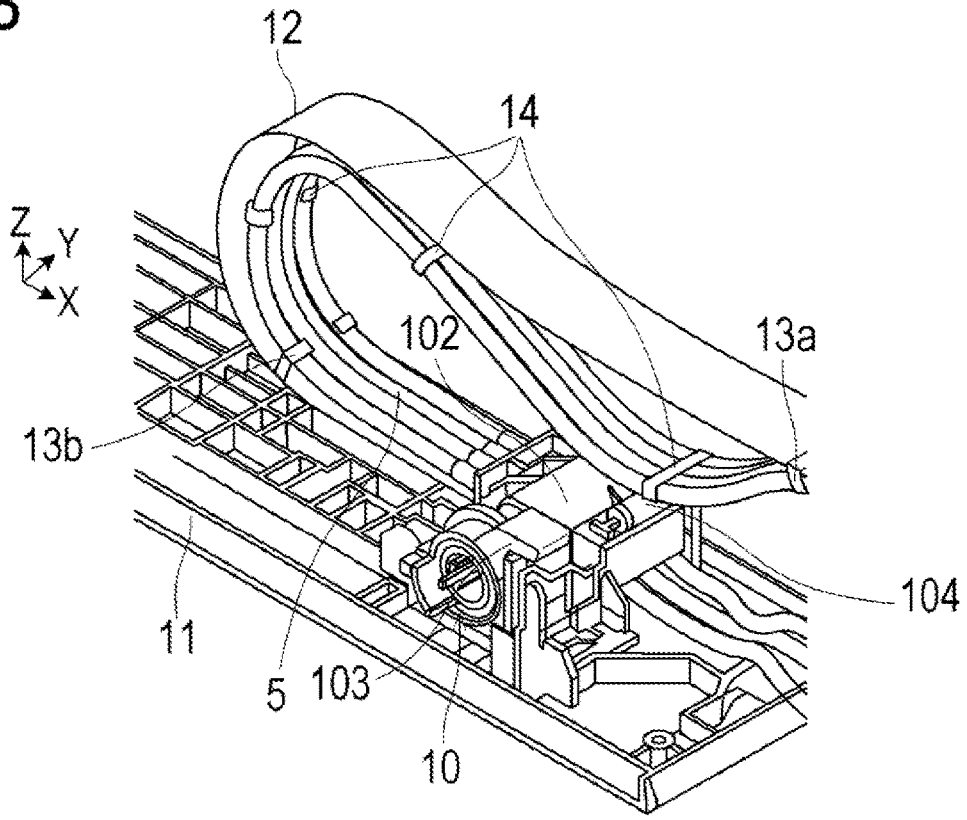

FIG. 7A is a schematic diagram depicting a state where the rotating member 104 contacts, supports and guides the sagging portion of the tubes 5 when the recording unit 2 is scanning, and FIG. 7B is an enlarged perspective view of a part of FIG. 7A. Even in the case where the tubes 5 sag down and the carriage 21 starts scanning, the tubes 5 contact the rotating member 104, and the movement of the carriage 21 is interrupted less by the tubes 5, as illustrated in FIG. 7A and FIG. 7B.

The position where the rotating member 104 is disposed is preferably on the side of the cap position (standby position) of the carriage 21, but is not limited to a specific position as long as the rotating member 104 can contact the sagging portion of the tubes 5 before the tube valve unit 10. For example, the rotating member 104 may be disposed on the opposite side of the cap position (standby position), that is distant from the cap position (standby position) of the tube valve unit 10.

The direction of laying the tubes 5 is not limited to the above mentioned configuration of this embodiment. For example, the tubes 5 may be laid such that the standby position is at the center in the carriage scanning direction, and the connecting portion of the tubes 5 with the carriage 21 extends in the opposite direction of this embodiment, and is then curved and returns to the direction of this embodiment.

A number of tubes 5 that are laid in a predetermined configuration is four in this embodiment, but the number of tubes 5 is not especially limited.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-130026, filed on Jul. 31, 2020, which is hereby incorporated by reference herein in its entirety.

What is claimed is:

1. An image recording apparatus comprising:

a carriage configured to support a recording head that ejects liquid and configured to move in a scanning direction;

a liquid containing portion configured to contain liquid that is supplied to the recording head;

a tube configured to connect the recording head and the liquid containing portion to supply liquid from the liquid containing portion to the recording head, the tube including (1) a first section that extends in the scanning direction and (2) a second section that extends in the scanning direction above the first section;

a support portion configured to support the first section and be secured to an apparatus main body; and a rotating member provided in the support portion and having a peripheral surface configured to contact the second section of the tube and to rotate in a case where the carriage is moving.

2. The image recording apparatus according to claim 1, wherein the first section extends from a connecting portion connected with the liquid containing portion to a first side in the scanning direction, and is supported by the support portion so as not to move while the carriage is moving, and wherein the second section (1) curves from a section, which is supported by the support portion, of the first section, (2) extends to a second side opposing to the first side in the scanning direction, and (3) moves while the carriage is moving.

3. The image recording apparatus according to claim 2, further comprising a conveying unit configured to convey a recording medium along a conveying path, wherein the liquid containing portion is disposed at a position that deviates from the conveying path to the second side in the scanning direction.

4. The image recording apparatus according to claim 3, wherein the carriage has a standby position at a position that deviates from the conveying path to the second side in the scanning direction, and wherein the connecting portion of the tube with the carriage is located above the connecting portion of the tube with the liquid containing portion in a state where the carriage is at the standby position.

5. The image recording apparatus according to claim 4, further comprising a guide plate extending over the conveying path in the scanning direction, and guides the first section of the tube, wherein the support portion is secured at a position in the guide plate above the conveying path, and wherein the rotating member is disposed in the support portion on a side closer to the standby position.

6. The image recording apparatus according to claim 1, wherein the rotating member is a cylindrical rotating member, and wherein a rotation axis of the rotating member is in a direction perpendicular to the scanning direction.

7. The image recording apparatus according to claim 1, wherein the peripheral surface contacts the second section of the tube in a case where the second section sags down, and rotates while the carriage is moving.

8. The image recording apparatus according to claim 1, further comprising a valve configured to control supply of liquid via the tube, wherein the support portion includes a valve holder portion configured to hold the valve.

9. The image recording apparatus according to claim 8, wherein the rotating member is disposed in the support portion on a side closer to the liquid containing portion than the valve holder portion, and wherein a height of an upper end of the rotating member is not more than a height of an upper end of the valve holder portion of the support portion.

10. The image recording apparatus according to claim 1, further comprising:

a guide sheet, one end of which is secured to the support portion and the other end of which is secured to the carriage, the guide sheet guiding a section of the tube from a section supported by the support portion to a section connected to the carriage; and a tube holder slider that includes an insertion portion to which the guide sheet is inserted, and a holding portion configured to hold the tube, the tube holder slider bundling the guide sheet and the tube at a predetermined location in the extending direction of the guide sheet.

11. The image recording apparatus according to claim 10, wherein the tube holder slider includes:

a first tube holder slider that bundles the guide sheet and the tube in the vicinity of one end of the guide sheet; and a second tube holder slider that bundles the guide sheet and the tube in the vicinity of the other end of the guide sheet, and wherein, in a state where the carriage is at a standby position, which is on the same side as a side of securing the liquid containing portion and deviates from the conveying path of the recording medium in the scanning direction, (1) the support portion is located on a side closer to the first tube holder slider in the scanning direction, and (2) the rotating member is disposed on a side closer to the second tube holder slider in the support portion in the scanning direction.

12. The image recording apparatus according to claim 1, further comprising the recording head.

13. An image recording apparatus comprising:

a carriage configured to support a recording head that ejects liquid and configured to perform reciprocating motion in a scanning direction;

a liquid containing portion configured to contain liquid that is supplied to the recording head;

a tube configured to supply liquid from the liquid containing portion to the recording head, the tube being connected so as to be laid between a first connecting portion connected with the liquid containing portion and a second connecting portion connected with the carriage which is located above the first connecting portion; and a support portion configured to support a side of the first connecting portion, and to be secured to an apparatus main body, wherein the support portion includes a rotating member that has a peripheral surface, and wherein the peripheral surface contacts a sagging section of the tube, and rotates while the carriage is moving.

* * * * *